US011852418B1

(12) United States Patent
Kordonowy et al.

(10) Patent No.: US 11,852,418 B1
(45) Date of Patent: Dec. 26, 2023

(54) COOLANT-FILLED HEAT EXCHANGER FOR AN OIL TREATER

(71) Applicant: Solid Solutions LLC, Dickinson, ND (US)

(72) Inventors: Gerald Arthur Kordonowy, Dickinson, ND (US); August Sawyer Kordonowy, Dickinson, ND (US)

(73) Assignee: Solid Solutions LLC, Dickinson, ND (US)

( * ) Notice: Subject to any disclaimer, the term of this patent is extended or adjusted under 35 U.S.C. 154(b) by 100 days.

(21) Appl. No.: 17/748,463

(22) Filed: May 19, 2022

Related U.S. Application Data

(60) Provisional application No. 63/194,808, filed on May 28, 2021.

(51) Int. Cl.
*F28D 1/02* (2006.01)

(52) U.S. Cl.
CPC ..... *F28D 1/0213* (2013.01); *F28D 1/0246* (2013.01)

(58) Field of Classification Search
CPC ..... F28D 1/0213; F28D 1/0246
USPC ..... 165/132
See application file for complete search history.

(56) References Cited

U.S. PATENT DOCUMENTS

| | | | | |
|---|---|---|---|---|
| 2,641,451 | A * | 6/1953 | Kaiser | F28D 7/12 165/142 |
| 3,757,745 | A * | 9/1973 | Miller | F22B 7/12 122/136 R |
| 3,788,390 | A * | 1/1974 | Lewers | F23K 5/20 165/96 |
| 7,726,298 | B2 * | 6/2010 | St. Denis | F28D 1/0213 126/360.1 |
| 10,024,572 | B1 * | 7/2018 | Stephens | F28D 1/0213 |
| 10,773,880 | B2 * | 9/2020 | Thiessen | B65D 88/748 |
| 2008/0066887 | A1 * | 3/2008 | Toh | F17C 1/00 165/74 |
| 2009/0151655 | A1 * | 6/2009 | Kohlman | F24H 1/205 122/5 |

FOREIGN PATENT DOCUMENTS

| | | | | |
|---|---|---|---|---|
| EP | 3159645 | A1 * | 4/2017 | F28D 1/0213 |
| FR | 2938318 | A1 * | 5/2010 | F24H 1/206 |
| FR | 2975170 | B1 * | 7/2019 | F24H 8/003 |

* cited by examiner

*Primary Examiner* — Jon T. Schermerhorn, Jr.
(74) *Attorney, Agent, or Firm* — Buckert Patent & Trademark Law Firm PC; John F. Buckert

(57) ABSTRACT

A coolant-filled heat exchanger is provided. The heat exchanger includes an inner u-shaped tube having first, second, and third inner tube portions defining an outer surface. The heat exchanger includes an outer u-shaped tube having first, second, and third outer tube portions defining an inner surface. The first, second, and third inner tube portions are disposed within the first, second, and third outer tube portions, respectively. An interior region is formed between the outer surface of the inner u-shaped tube and the inner surface of the outer u-shaped tube. The heat exchanger includes a mounting plate having first and second apertures. The first and second outer tube portions extend into the first and second apertures, respectively, and are coupled to the mounting plate. The interior region is adapted to be filled with a coolant.

12 Claims, 15 Drawing Sheets

COOLANT-FILLED HEAT EXCHANGER FOR AN OIL TREATER

CROSS-REFERENCE TO RELATED APPLICATIONS

This application claims priority to U.S. Provisional Patent Application No. 63/194,808 filed on May 28, 2021, the entire contents of which are hereby incorporated by reference herein.

BACKGROUND

Oil treaters are used to separate two-phase and three-phase oil emulsions, containing oil and gas and/or water that are received from oil wells. As the oil mixture is heated to about 140 degrees Fahrenheit, the oil, water, and gas are separated. Due to uneven heating by the flame of the inner burner and due to direct contact of the flame against the inner wall of the fire tube, oil and gas treaters are typically susceptible to pre-mature failure due to hot spots on the metal created by the uneven heating. As a result, accelerated corrosion of the metal located at the hot spots, is caused by the emulsion boiling at the outer metal surface of the fire tubes in thermal communication with the hot spots.

Because of the accelerated corrosion, the oil treaters prematurely fail with the consequence of pitting, faults, and/or openings in a burner tube holding a burner nozzle therein. Oil, water, and gas leaks are thereby facilitated through these cracks and faults, and into the interior of the burner tube. Fire hazards, environmental issues, and safety issues result as the oil emulsion leaks into the fireside of the burner tube and down toward the burner nozzle. Accordingly, the affected oil treaters must be removed from service and costly maintenance and repairs must be completed before the treaters can be reintroduced into service. Ultimately, such failure requires the repair or replacement of the burner tube well before the time and duration of its expected normal use.

The inventors herein have recognized the need for a coolant-filled heat exchanger for an oil treater that minimizes and/or reduces the abovementioned deficiency.

SUMMARY

A coolant-filled heat exchanger in accordance with an exemplary embodiment is provided. The coolant-filled heat exchanger includes an inner u-shaped tube having first, second, and third inner tube portions each having a first diameter. The first, second, and third inner tube portions define an outer surface. The coolant-filled heat exchanger further includes an outer u-shaped tube having first, second, and third outer tube portions each having a second diameter. The second diameter is greater than the first diameter. The first, second, and third outer tube portions define an inner surface. The first, second, and third inner tube portions are disposed within the first, second, and third outer tube portions, respectively. An interior region is formed between the outer surface of the inner u-shaped tube and the inner surface of the outer u-shaped tube. The coolant-filled heat exchanger further includes a mounting plate having first and second apertures extending therethrough. The first outer tube portion extends into the first aperture and is coupled to the mounting plate. The second outer tube portion extends into the second aperture and is coupled to the mounting plate. The coolant-filled heat exchanger further includes a first ring-shaped end plate coupled to and between the outer surface of the first inner tube portion and the inner surface of the first outer tube portion to enclose and seal a first opening communicating with the interior region. The first ring-shaped end plate is disposed a first distance from an open end of the first inner tube portion. The coolant-filled heat exchanger further includes a second ring-shaped end plate coupled to and between the outer surface of the second inner tube portion and the inner surface of the second outer tube portion to enclose and seal a second opening communicating with the interior region. The second ring-shaped end plate is disposed the first distance from an open end of the second inner tube portion. The interior region is adapted to be filled with a coolant.

A coolant-filled heat exchanger in accordance with another exemplary embodiment is provided. The coolant-filled heat exchanger includes an inner u-shaped tube having first, second, and third inner tube portions that define an outer surface. The coolant-filled heat exchanger further includes a housing having an inner surface and an open end. The inner u-shaped tube is at least partially disposed in the housing. An interior region is formed between the outer surface of the inner u-shaped tube and the inner surface of the housing. The coolant-filled heat exchanger further includes a mounting plate that is coupled to the housing and encloses the open end of the housing. The mounting plate has first and second apertures extending therethrough. The coolant-filled heat exchanger further includes a first ring-shaped end plate that is disposed in the first aperture of the mounting plate and is coupled to the mounting plate. The first ring-shaped end plate has a central aperture that the first inner tube portion of the inner u-shaped tube extends therethrough. The first inner tube portion is coupled to the first ring-shaped end plate. The coolant-filled heat exchanger further includes a second ring-shaped end plate is disposed in the second aperture of the mounting plate and is coupled to the mounting plate. The second ring-shaped end plate has a central aperture that the second inner tube portion of the inner u-shaped tube extends therethrough. The second inner tube portion is coupled to the second ring-shaped end plate. The interior region is adapted to be filled with a coolant.

DETAILED DESCRIPTION

Figure 1:
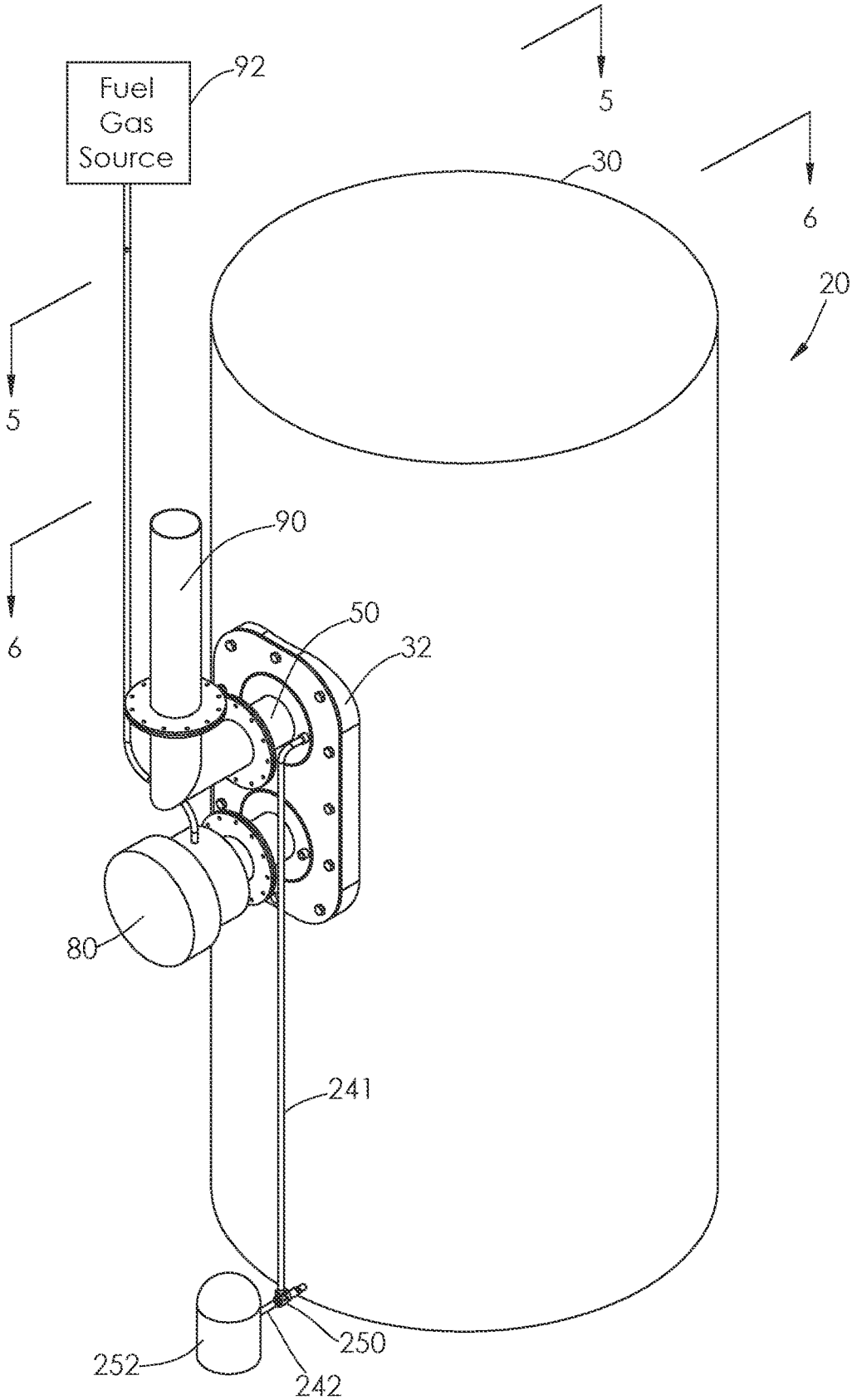
FIG. 1 is isometric view of an oil treater having a coolant-filled heat exchanger in accordance with an exemplary embodiment.
Figure 2:
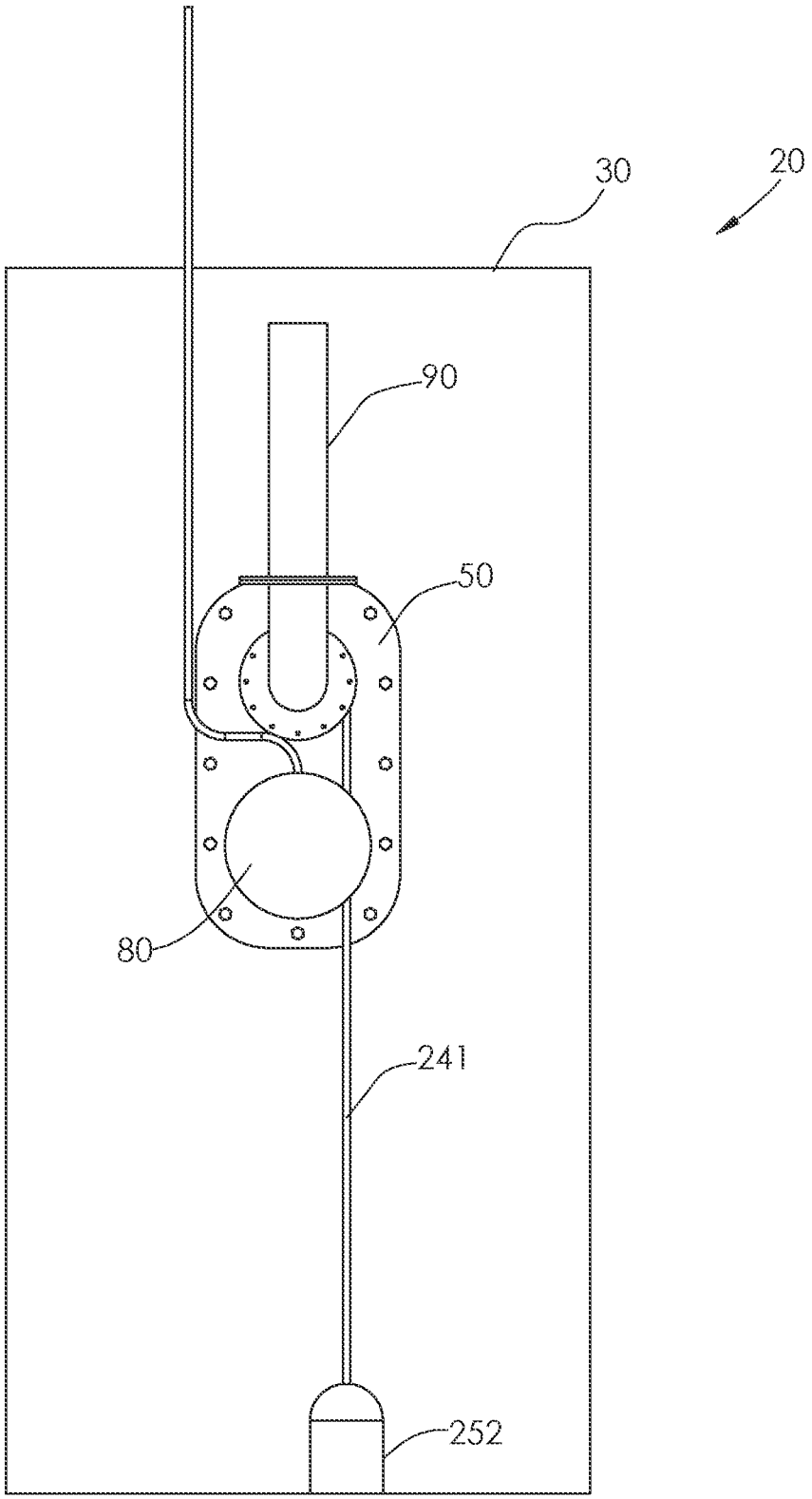
FIG. 2 is a front view of the oil treater of FIG. 1.

Referring to FIGS. 1-4, an oil treater 20 that heats and separates two-phase and three-phase oil emulsions, containing oil and gas and/or water is illustrated. The oil treater 20 includes a storage tank 30, a mounting flange 32, a coolant-filled heat exchanger 50, a centralizer 52 (shown in FIG. 3), bolts 61, 62, 63, 64, 65, 66, 67, 68, 69, 70, 71, 72, a burner assembly 80, an exhaust assembly 90, and a fuel gas source 92. The term "approximately" used herein means+−20%.

Figure 3:
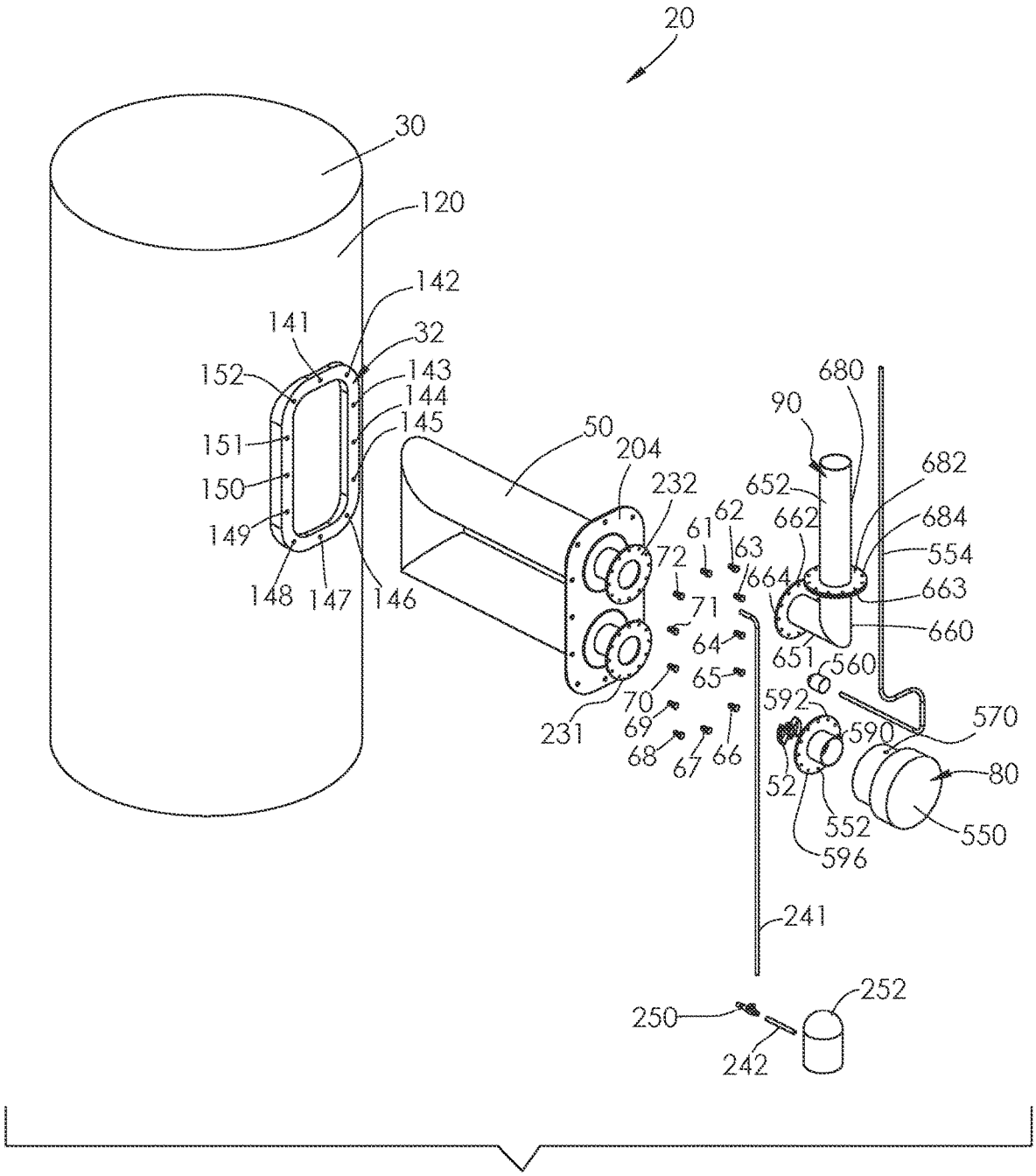
FIG. 3 is an exploded view of the oil treater of FIG. 1.
Figure 4:
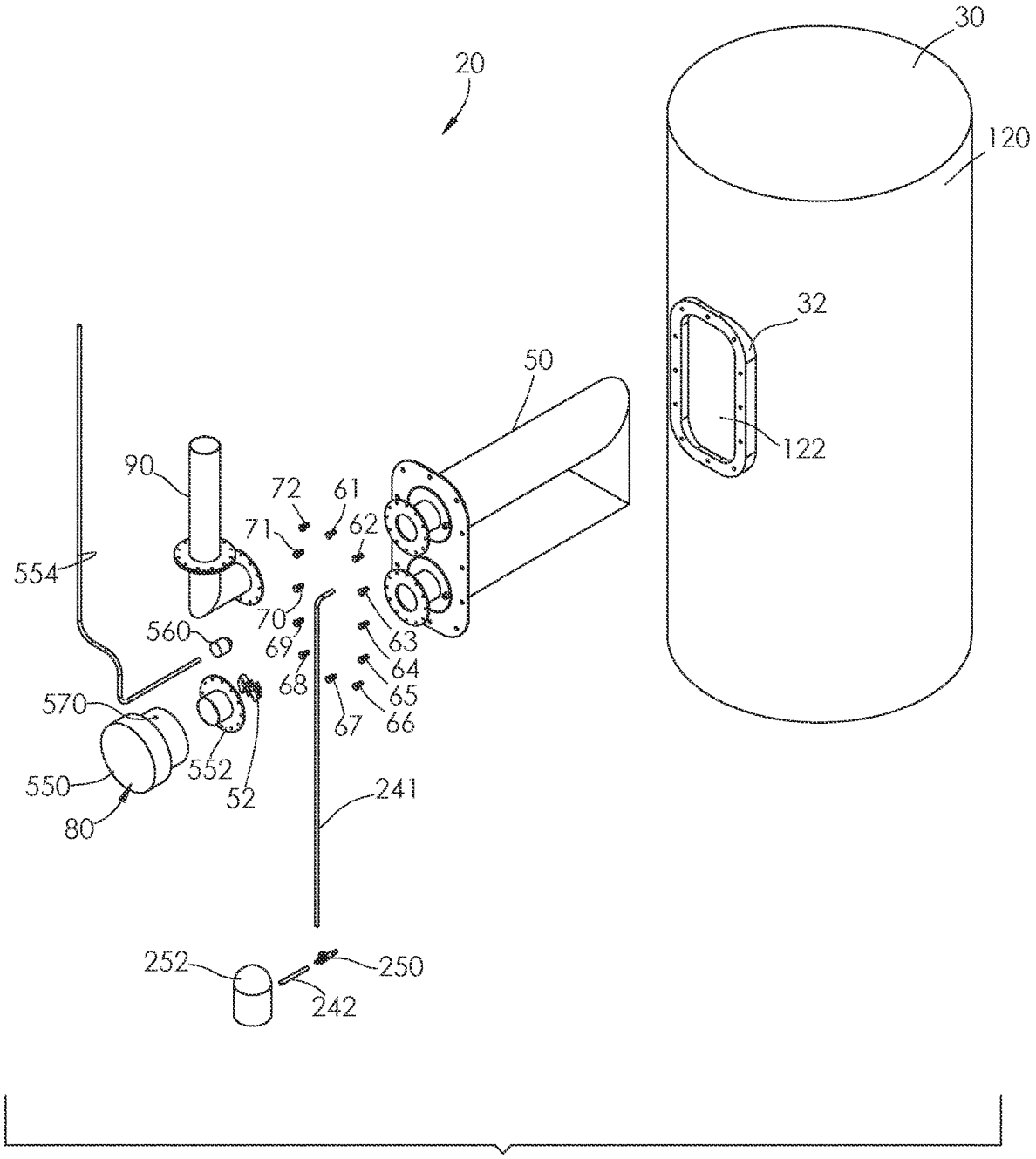
FIG. 4 is another exploded view of the oil treater of FIG. 1.

Referring to FIGS. 3 and 4, the storage tank 30 is provided to hold two-phase and three-phase oil emulsions therein. The storage tank 30 includes a tank housing 120 having an opening 122. The opening 122 is sized and shaped to receive the mounting flange 32 therein. In an exemplary embodiment, the storage tank 30 is constructed of a metal such as steel for example.

The ring-shaped mounting flange 32 is welded to the storage tank 30 and surrounds a periphery of the opening 122. The mounting flange 32 includes a body 130 having bolt holes 141, 142, 143, 144, 145, 146, 147, 148, 149, 150, 151, 152 extending therein. The ring-shaped mounting flange 32 is coupled to the mounting plate 204 of the coolant-filled heat exchanger 50 utilizing bolts. In an exemplary embodiment, the ring-shaped mounting flange 32 is constructed of a metal such as steel for example.

Referring to FIGS. 4-15, the coolant-filled heat exchanger 50 is provided to be coupled to the storage tank 30 and to transfer heat energy from the burner assembly 80 into an oil emulsion within the storage tank 30. Referring to FIGS. 1 and 9-13, the coolant-filled heat exchanger 50 includes an inner u-shaped tube 200, an outer u-shaped tube 202, a mounting plate 204, a first ring-shaped end plate 211, a second ring-shaped end plate 212, a first fluid port 221, a second fluid port 222, a first ring-shaped coupling flange 231, a second ring-shaped coupling flange 232, a first tube 241, a second tube 242, a pressure relief valve 250 (shown in FIG. 1), and an expansion tank 252. An advantage of the coolant-filled heat exchanger 50 is that the heat exchanger 50 substantially maintains a similar temperature (e.g., approximately 212 degrees Fahrenheit) along an outer surface of the outer u-shaped tube 202 to reduce hot spots on the tube 202 which increases an operational life of the coolant-filled heat exchanger 50.

Figure 10:
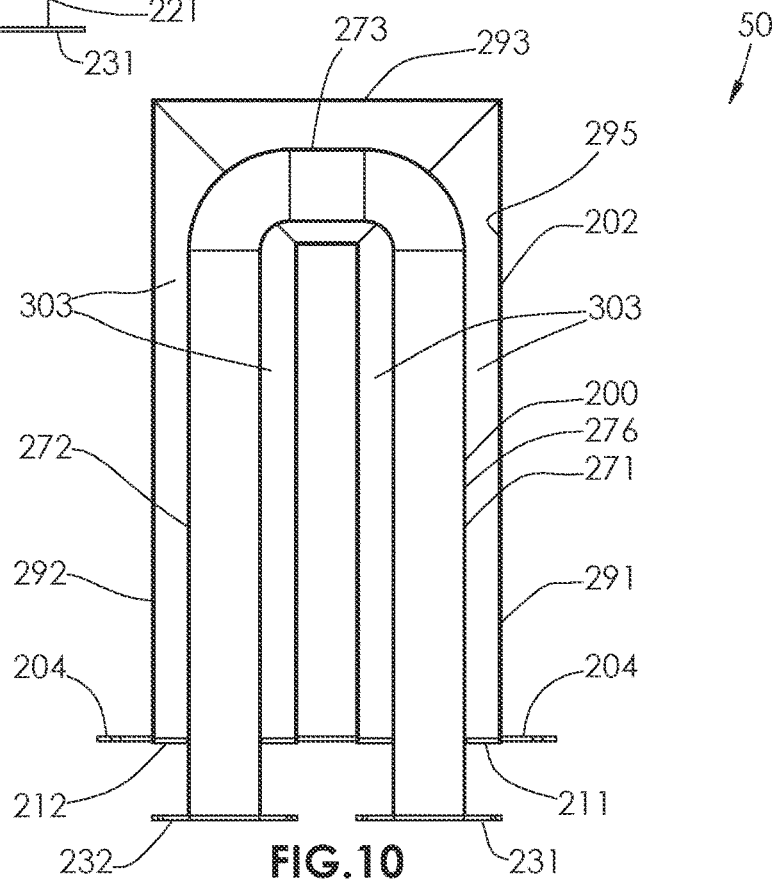
FIG. 10 is a cross-sectional view taken along lines 10-10 in FIG. 8.
Figure 11:
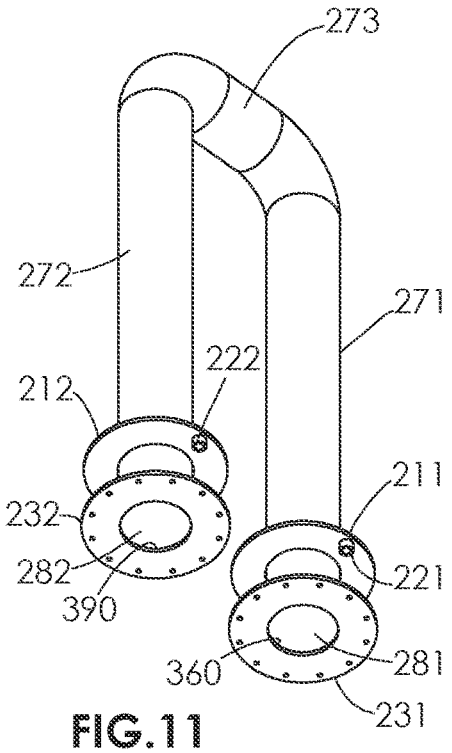
FIG. 11 is an isometric view of an inner u-shaped tube, first and second ring-shaped end plates, and first and second ring-shaped coupling flanges utilized in the coolant-filled heat exchanger of FIG. 8.
Figure 12:
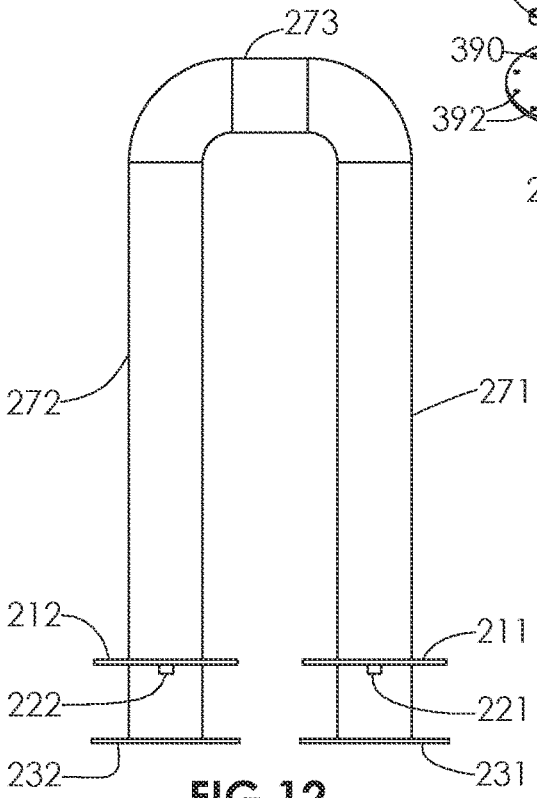
FIG. 12 is a front view of the inner u-shaped tube, the first and second ring-shaped end plates, and the first and second ring-shaped coupling flanges of FIG. 11.

Referring to FIGS. 10-12, the inner u-shaped tube 200 has first, second, and third inner tube portions 271, 272, 273 coupled together each having a first diameter. The first, second, and third inner tube portions 271, 272, 273 define an outer surface 276. The first and second inner tube portions 271, 272 extend parallel to one another, and the third inner tube portion 273 extends perpendicular to and between the first and second inner tube portions 271, 272. The first inner tube portion 271 includes an open end 281 (shown in FIG. 11), and the second inner tube portion 272 includes an open end 282. In an exemplary embodiment, the inner u-shaped tube 200 is constructed of a metal such as steel example.

Figure 9:
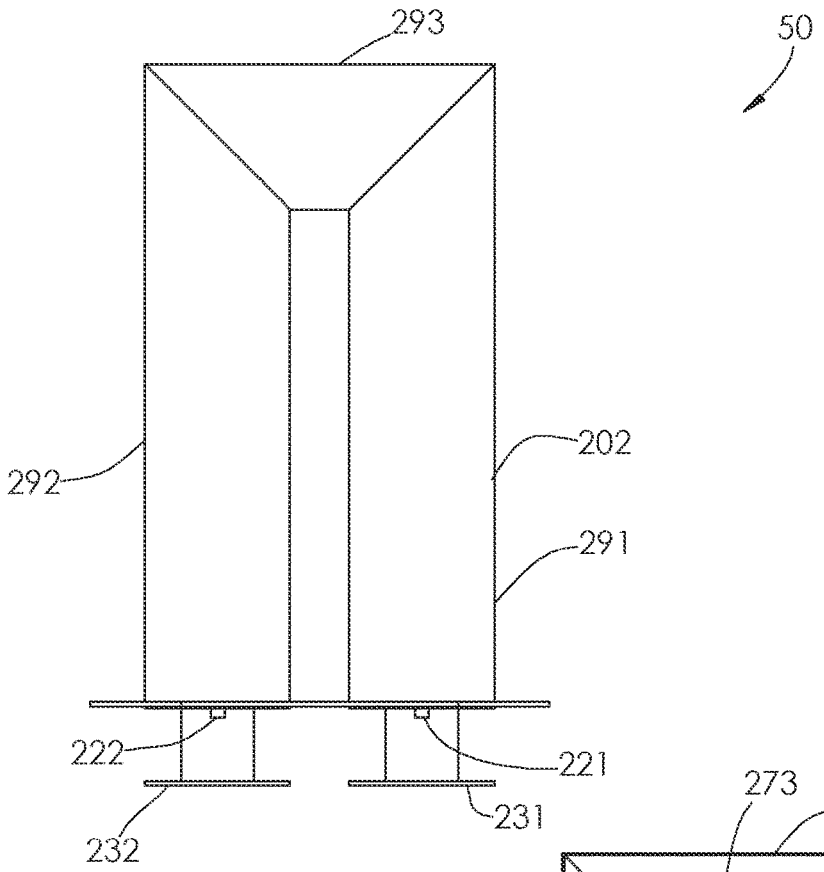
FIG. 9 is a front view of the coolant-filled heat exchanger of FIG. 8.
Figure 14:
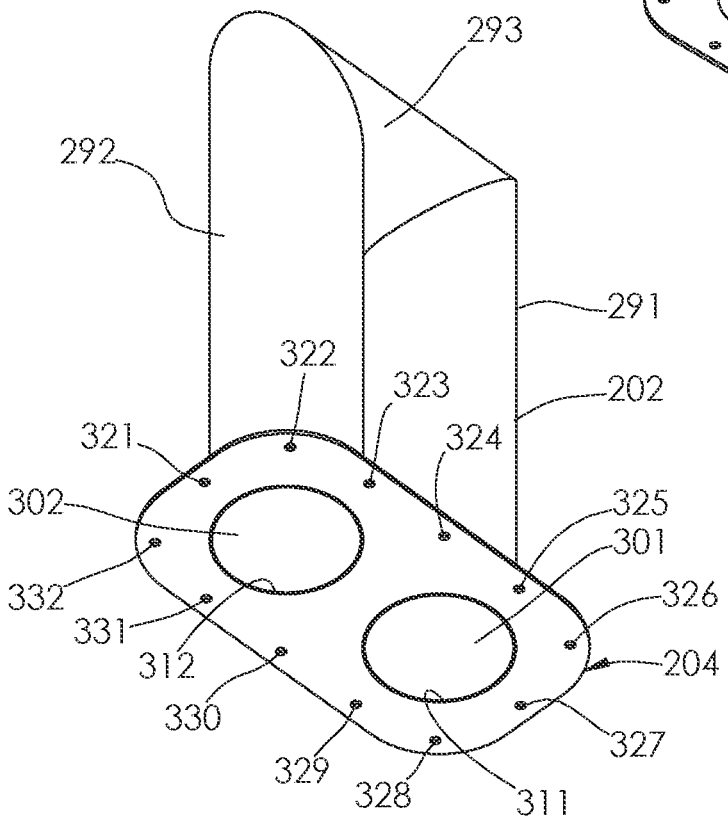
FIG. 14 is an isometric view of an outer u-shaped tube and a mounting plate utilized in the coolant-filled heat exchanger of FIG. 8.

Referring to FIGS. 9, 10 and 14, an outer u-shaped tube 202 has first, second, and third outer tube portions 291, 292, 293 coupled together each having a second diameter. The second diameter is greater than the first diameter of the inner u-shaped tube 200. In an exemplary embodiment, the first diameter is eight inches, and the second diameter is sixteen inches. The first, second, and third outer tube portions 291, 292, 293 define an inner surface 295. The first, second, and third inner tube portions 271, 272, 273 are disposed within the first, second, and third outer tube portions 291, 292, 293, respectively. The first and second outer tube portions 291, 292 extend parallel to one another, and the third outer tube portion 293 extends perpendicular to and between the first and second outer tube portions 291, 292. The first outer tube portion 291 has an open end 301 (shown in FIG. 14), and the second outer tube portion 292 includes an open end 302. In an exemplary embodiment, the outer u-shaped tube 202 is constructed of a metal such as steel example. An interior region 303 (shown in FIG. 10) is formed between the outer surface 276 of the inner u-shaped tube 200 and the inner surface 295 of the outer u-shaped tube 202.

Figure 15:
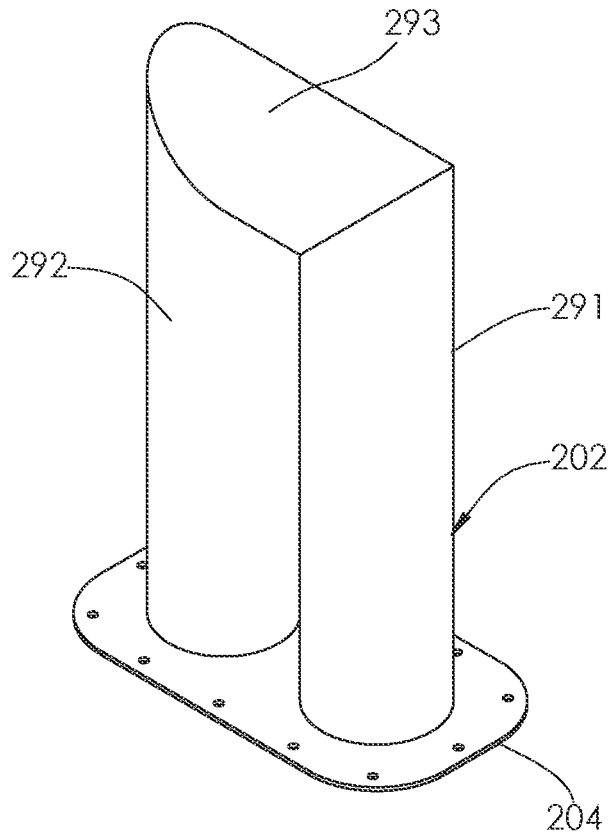
FIG. 15 is another isometric view of the outer U-shaped tube and the mounting plate of FIG. 14.

Referring to FIGS. 14 and 15, a mounting plate 204 is coupled to the outer u-shaped tube 202. The mounting plate 204 includes first and second apertures 311, 312 and bolt holes 321, 322, 323, 324, 325, 326, 327, 328, 329, 330, 331, 332 extending therethrough. The first outer tube portion 291 extends into the first aperture 311 and is coupled to the mounting plate 204. The second outer tube portion 292 extends into the second aperture 312 and is coupled to the mounting plate 204. Referring to FIGS. 3, 14 and 15, the bolts 61, 62, 63, 64, 65, 66, 67, 68, 69, 70, 71, 72 extend through the bolt holes 321, 322, 323, 324, 325, 326, 327, 328, 329, 330, 331, 332, respectively of the mounting plate 204, and into the bolt holes 141, 142, 143, 144, 145, 146, 147, 148 149, 100, 152, respectively, of the ring-shaped mounting flange 32 to couple the mounting plate 204 to the ring-shaped mounting flange 32. In an exemplary embodiment, the mounting plate 204 is constructed of a metal such as steel for example.

Referring to FIGS. 10-13, the first ring-shaped end plate 211 is coupled to and between the outer surface 276 of the first inner tube portion 271 and the inner surface 295 of the first outer tube portion 291 to enclose and seal a first opening communicating with the interior region 303. The first ring-shaped end plate 211 is disposed a first distance from the open end 281 (shown in FIG. 11) of the first inner tube portion 271. The first ring-shaped end plate 211 has a port aperture 342 (shown in FIG. 13) that receives a first fluid port 221 therein. The first fluid port 221 is coupled to the first ring-shaped end plate 211 and fluidly communicates with the interior region 303. In an exemplary embodiment, the first ring-shaped end plate 211 is constructed of a metal such as steel for example.

The second ring-shaped end plate 212 is coupled to and between the outer surface 276 of the second inner tube portion 272 and the inner surface 295 of the second outer tube portion 292 to enclose and seal a second opening communicating with the interior region 303. The second ring-shaped end plate 212 is disposed the first distance from an open end 282 (shown in FIG. 11) of the second inner tube portion 272. The second ring-shaped end plate 212 has a port aperture 352 that receives a second fluid port 222 therein. The second fluid port 222 is coupled to the second ring-shaped end plate 212 and fluidly communicates with the interior region 303. In an exemplary embodiment, the second ring-shaped end plate 212 is constructed of a metal such as steel for example.

The interior region 303 is filled with a coolant utilizing the first and second fluid ports 221, 222. In particular, after the installation of the coolant-filled heat exchanger 50 to the storage tank 30, a coolant is pumped from an exterior coolant tank (not shown) through the fluid port 222 into the interior region 303 of the storage tank 30 while air is evacuated out of the fluid port 221. The fluid port 221 is sealed after the coolant is disposed in the interior region 303. Thereafter, the fluid port 222 is coupled to the tube 241 (shown in FIG. 6) which is further coupled to the pressure relief valve 250. The pressure relief valve 250 is further coupled to the expansion tank 252. In an exemplary embodiment, the coolant is a liquid coolant. Further, in an exemplary embodiment, the liquid coolant is at least one of an ethylene glycol/water mixture and a mono-ethylene glycol. The liquid coolant maintains a temperature in the interior region 303 at approximately 212 degrees Fahrenheit.

Referring to FIGS. 3 and 11-13, the first ring-shaped coupling flange 231 is coupled to an end of the first inner tube portion 271 that extends outwardly from the mounting plate 204. The first ring-shaped coupling flange 231 includes a central aperture 360 and a plurality of bolt holes 362 extending therethrough. The central aperture 360 aligns with and fluidly communicates with the open end 281 of the first inner tube portion 271. A plurality of bolts (not shown) are disposed through the plurality of bolt holes 362 and the and a plurality of bolt holes 596 (shown in FIG. 3) of the mounting member 552 of the burner assembly 80 to couple the first ring-shaped coupling flange 231 to the mounting member 552. In an exemplary embodiment, the first ring-shaped coupling flange 231 is constructed of a metal such as steel for example.

The second ring-shaped coupling flange 232 is coupled to an end of the second inner tube portion 272 that extends outwardly from the mounting plate 204. The second ring-shaped coupling flange 232 includes a central aperture 390 and a plurality of bolt holes 392 extending therethrough. The central aperture 390 aligns with and fluidly communicates with the open end 282 of the second inner tube portion 272. A plurality of bolts (not shown) are disposed through the plurality of bolt holes 392 and the plurality of bolt holes 664 (shown in FIG. 3) of the ring-shaped mounting flange 662 of the exhaust assembly 90 to couple the second ring-shaped coupling flange 232 to the exhaust assembly 90. In an exemplary embodiment, the second ring-shaped coupling flange 232 is constructed of a metal such as steel for example.

Figure 6:
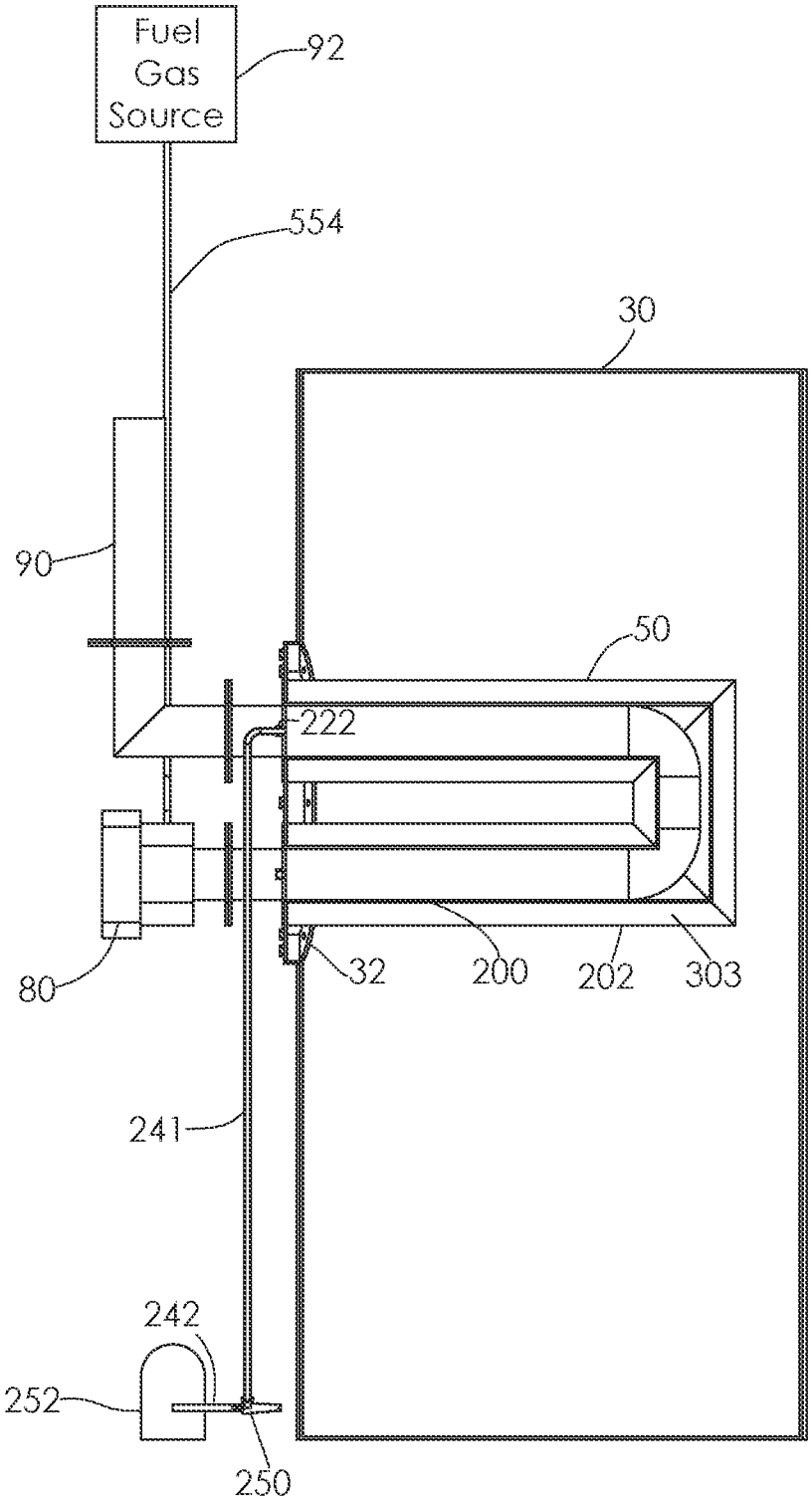
FIG. 6 is a cross-sectional view of the oil treater taken along lines 6-6 in FIG. 1.
Figure 8:
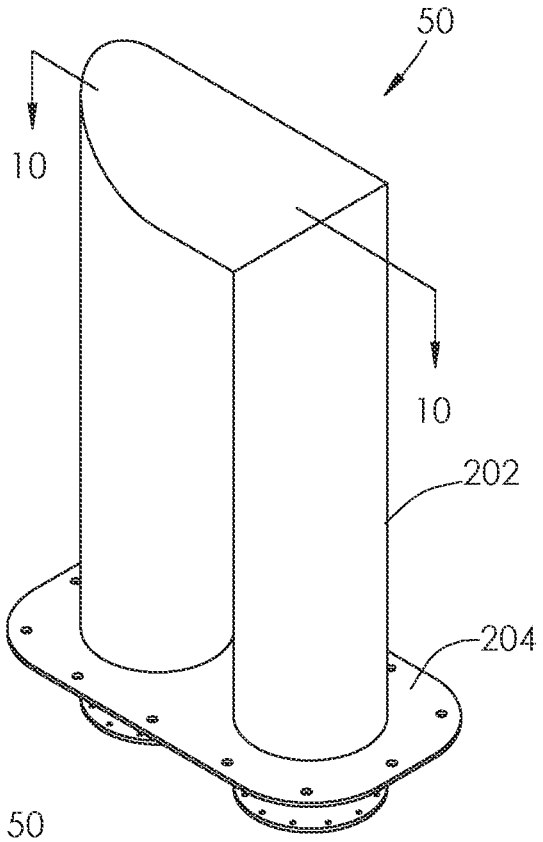
FIG. 8 is another isometric view of the coolant-filled heat exchanger of FIG. 7.
Figure 7:
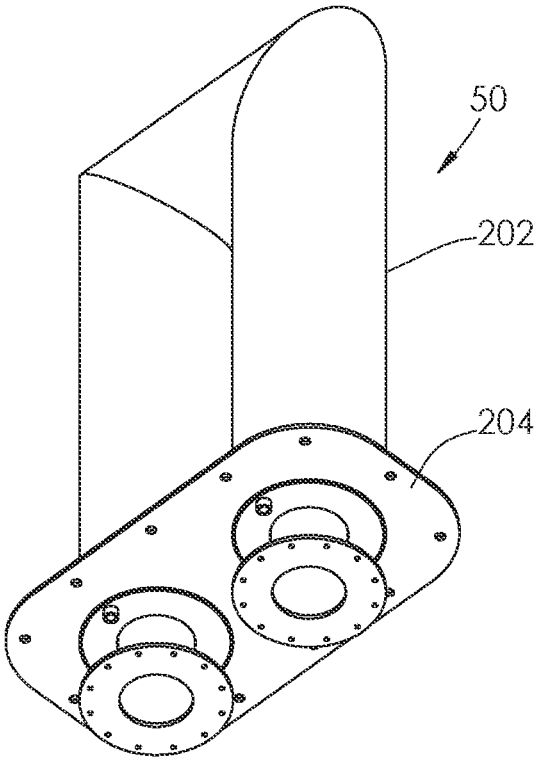
FIG. 7 is an isometric view of the coolant-filled heat exchanger of FIG. 1.

Referring to FIGS. 3, 4 and 6, the pressure relief valve 250 is coupled between the first tube 241 (which is coupled to be fluid port 222) and the second tube 242 (which is coupled to the expansion tank 252). During operation of the coolant-filled heat exchanger 50, the expansion tank 252 fluidly communicates with the interior region 303 via the pressure relief valve 250 such that the expansion tank 252 has the same internal pressure as the interior region 303. However, if a pressure within the interior region 303 is greater than or equal to a threshold pressure level, the pressure relief valve 250 will allow coolant from the interior region 303 to vent to atmosphere to thereby decrease the pressure within the interior region 303.

Referring to FIGS. 3, 5, 16 and 17, the centralizer 52 is disposed within the first inner tube portion 271 of the inner u-shaped tube 200 and is provided to hold the burner nozzle 560 at a central position (e.g., a centered position) within the first inner tube portion 271. The centralizer 52 includes a first centralizer portion 421, a second centralizer portion 422, and bolts 431, 432, 433, 434, and nuts 441, 442, 443, 444.

The first centralizer portion 421 includes a mounting portion 460 and a spacer portion 462 integrally formed with the mounting portion 460. The mounting portion 460 includes bolt holes 471, 472, 473, 474 extending therethrough.

The second centralizer portion 422 includes a mounting portion 490 and a spacer portion 492 integrally formed with the mounting portion 490. The mounting portion 490 includes bolt holes 501, 502, 503, 504 extending therethrough.

The first and second centralizer portions 421, 422 are coupled together utilizing the bolts 431, 432, 433, 434. In particular, the bolts 431, 432, 433, 434 extend through the bolt holes 471, 472, 473, 474, respectively, of the first centralizer portion 421, and further extend through the bolt holes 501, 502, 503, 504, respectively of the second centralizer portion 422. The nuts 441, 442, 443, 444 are then threadably coupled to the ends of the bolts 431, 432, 433, 434, respectively.

Figure 5:
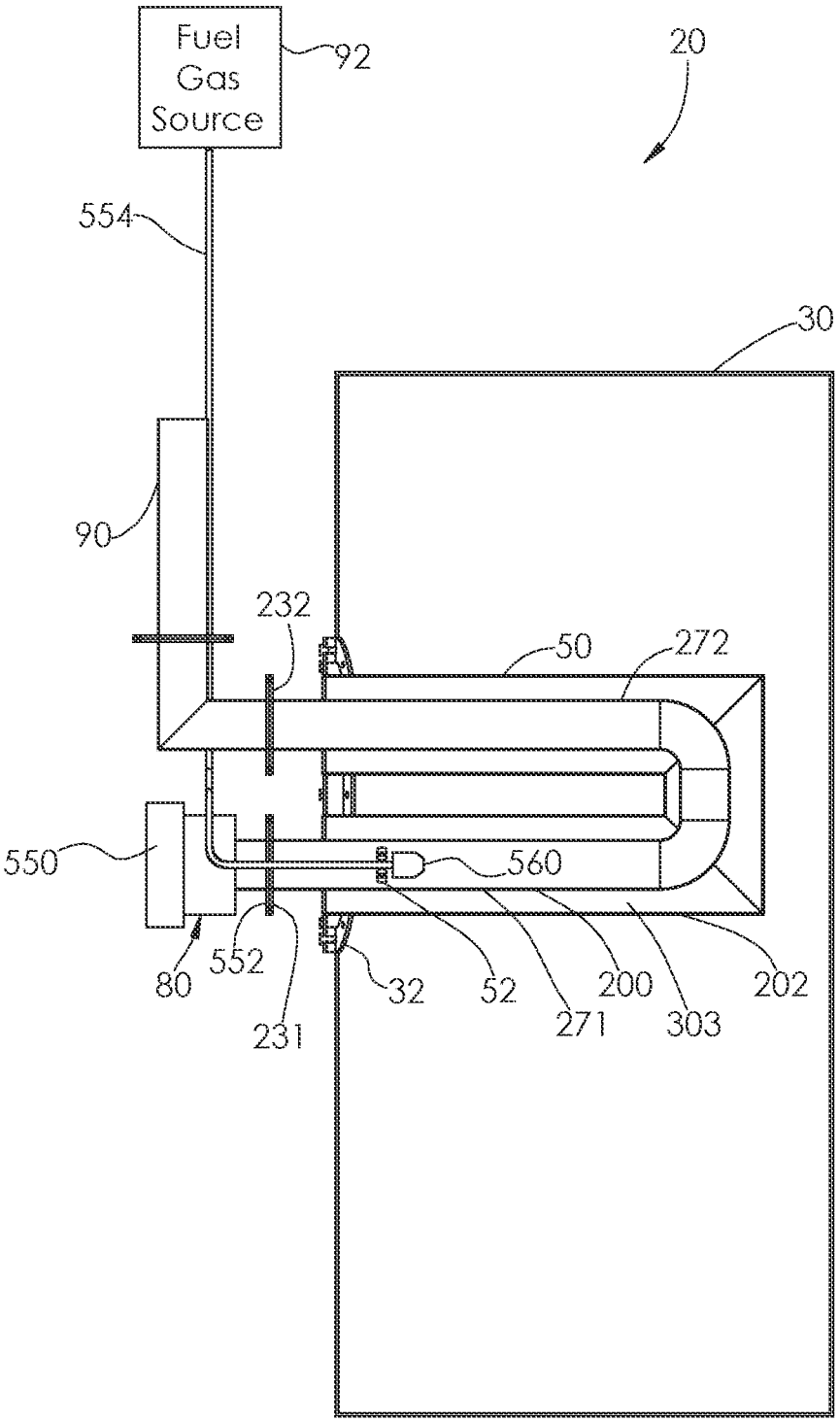
FIG. 5 is a cross-sectional view of the oil treater taken along lines 5-5 in FIG. 1.
Figure 16:
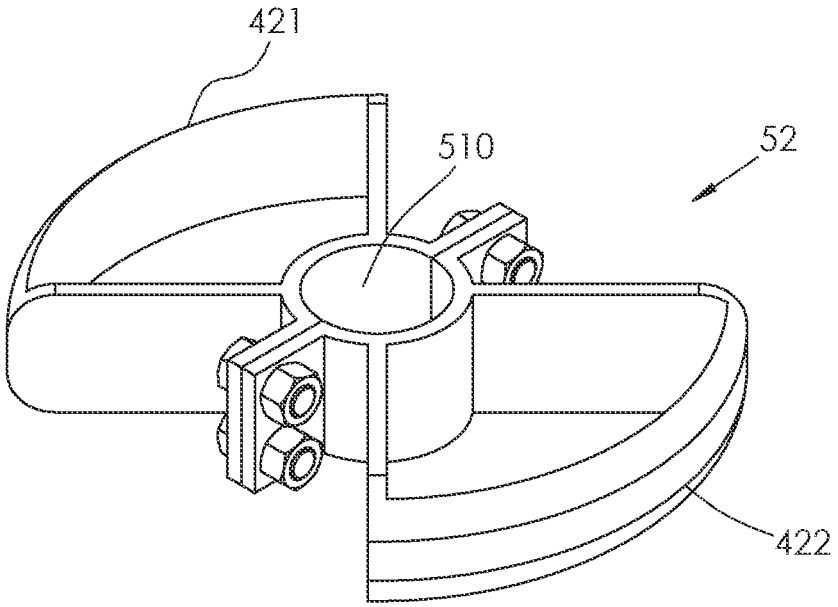
FIG. 16 is an isometric view of a centralizer utilized in the coolant-filled heat exchanger of FIG. 8.
Figure 17:
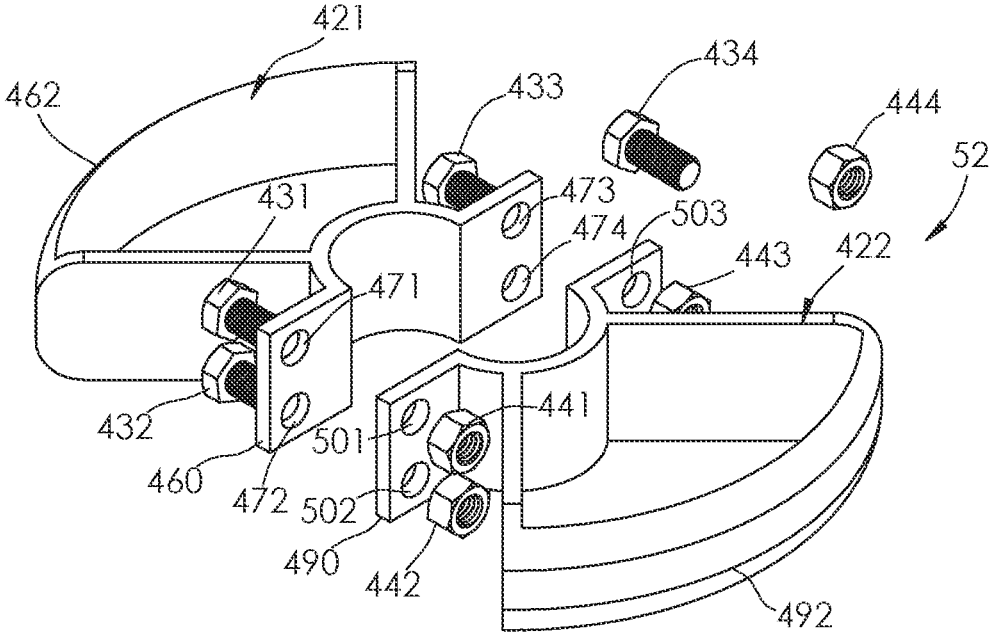
FIG. 17 is an exploded view of the centralizer of FIG. 16.
Figure 18:
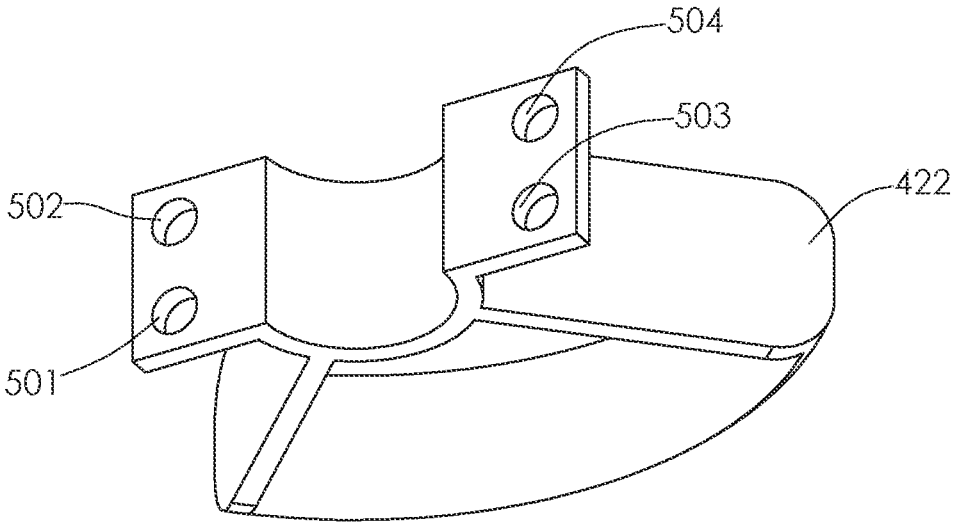
FIG. 18 is an isometric view of a centralizer portion utilized in the centralizer of FIG. 17.

Referring to FIGS. 5 and 16, the first and second centralizer portions 421, 422 form a central aperture 510 therebetween that receives and holds the inlet tube 554 which is further coupled to the burner nozzle 560. The first and second centralizer portions 421, 422 hold the inlet tube 554 and the burner nozzle at a central position within the first inner tube portion 271 of the inner u-shaped tube 200. In an exemplary embodiment, the first and second centralizer portions 421, 422 are constructed of a metal such as steel for example.

Referring to FIGS. 3 and 5, the burner assembly 80 is provided to receive natural gas or propane from a fuel gas source 92 and to burn the natural gas at the burner nozzle 560 such that heat energy is transferred through the inner u-shaped tube 200 to the coolant within the interior region 303. Thereafter, the heat energy is transferred from the coolant through the outer u-shaped tube 202 to an oil emulsion disposed within the storage tank 30 to heat the oil emulsion. The burner assembly 80 is coupled to the coolant-filled heat exchanger 750.

The burner assembly 80 includes a housing 550, a mounting member 552, an inlet tube 554, and a burner nozzle 560. The inlet tube 554 is disposed between and is fluidly coupled to the fuel gas source 92 and the burner nozzle 560. The inlet tube 554 extends through an aperture 570 in the housing 550 and then through the mounting member 552 and into the first inner tube portion 271. The burner nozzle 560 is fluidly coupled to an end of the inlet tube 554 within the first inner tube portion 271.

The mounting member 552 is coupled to both the housing 550 and the first ring-shaped coupling flange 231 of the coolant-filled heat exchanger 50. The mounting member 552 includes a tubular portion 590 and a ring-shaped mounting flange 592 coupled to the tubular portion 590. The ring-shaped mounting flange 592 includes a plurality of bolt holes 596 extending therethrough. A plurality of bolts (not shown) extend through the plurality of bolt holes 596 of the ring-shaped mounting flange 592 and a plurality of bolt holes 362 (shown in FIG. 13) of the first ring-shaped coupling flange 231 of the coolant filled heat exchanger 50 to couple the ring-shaped mounting flange 592 to the first ring-shaped coupling flange 231.

Referring to FIGS. 3 and 5, the exhaust assembly 90 is coupled to the second ring-shaped coupling flange 232 of the coolant-filled heat exchanger 750. The exhaust assembly 90 receives burnt gases from the burner assembly 80 via the second inner tube portion 272 and routes the gases out of the exhaust assembly 90. The exhaust assembly includes a first exhaust portion 651 and a second exhaust portion 652 coupled together.

The first exhaust portion 651 includes an L-shaped tube 660 and first and second ring-shaped mounting flanges 662, 663 coupled to opposite ends of the L-shaped tube 660. The first ring-shaped mounting flange 662 includes a plurality of apertures 664 extending therethrough. The second ring-shaped mounting flange 663 includes a plurality of apertures (not shown) extending therethrough.

The second exhaust portion includes a tube 680 and a ring-shaped mounting flange 682 coupled together. The ring-shaped mounting flange 682 includes a plurality of apertures 684 extending therethrough.

Referring to FIG. 3, a plurality of bolts (not shown) are disposed through the plurality of apertures of the second ring-shaped mounting flange 663 and the plurality of apertures 684 of the ring-shaped mounting flange 682 to couple the second ring-shaped mounting flange 663 to the ring-shaped mounting flange 682.

Figure 13:
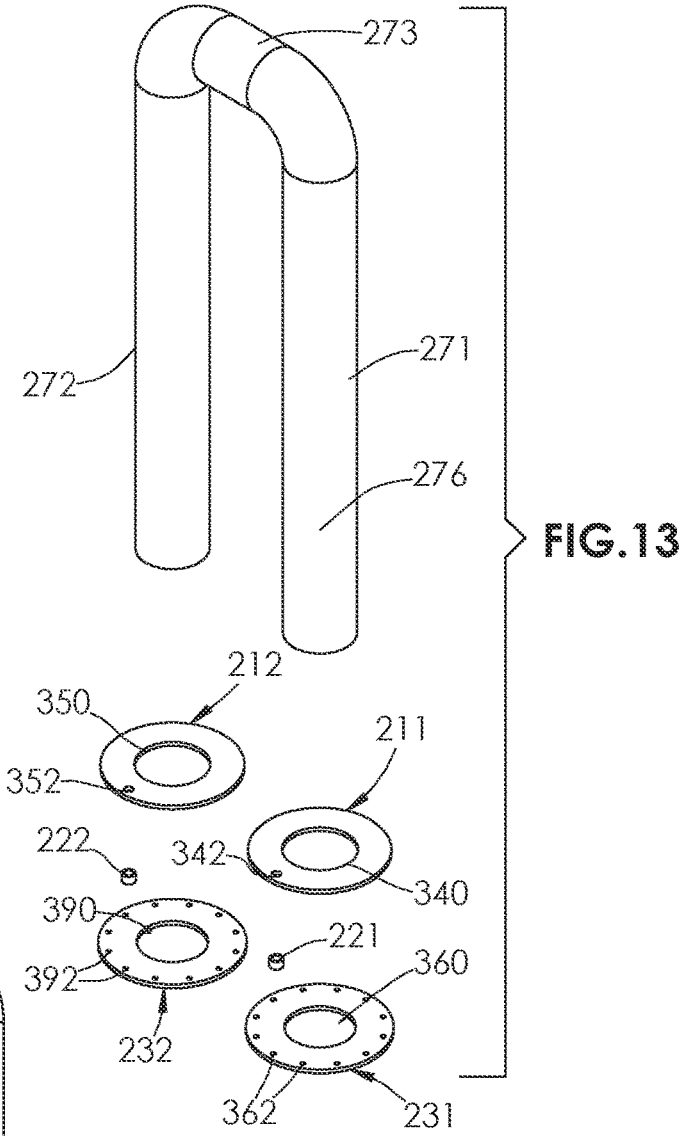
FIG. 13 is an exploded view of the inner u-shaped tube, the first and second ring-shaped end plates, and the first and second ring-shaped coupling flanges of FIG. 11.

Referring to FIGS. 3 and 13, a plurality of bolts (not shown) are disposed to the plurality of apertures 664 in the ring-shaped mounting flange 662 and the plurality of apertures 392 of the second ring-shaped coupling flange 232 to couple the ring-shaped mounting flange 662 to the second ring-shaped coupling flange 23.

Referring to FIGS. 1 and 19-23, a coolant-filled heat exchanger 750 that can be utilized in the storage tank 30 instead of the coolant-filled heat exchanger 50, in accordance with another exemplary embodiment is shown. The coolant-filled heat exchanger 750 is provided to be coupled to the storage tank 30 and to transfer heat energy from the burner assembly 80 into an oil emulsion within the storage tank 30. An advantage of the coolant-filled heat exchanger 750 is that the heat exchanger 750 substantially maintains a similar temperature (e.g., approximately 212 degrees Fahrenheit) along an outer surface of a housing 802 to reduce hot spots on the housing 802 which increases an operational life of the coolant-filled heat exchanger 750.

The coolant-filled heat exchanger 750 includes an inner u-shaped tube 800, a housing 802, a mounting plate 804, a first ring-shaped end plate 811, a second ring-shaped end plate 812, a first fluid port 821, a second fluid port 822, a first ring-shaped coupling flange 831, and a second ring-shaped coupling flange 832.

Referring to FIGS. 19-23, the inner u-shaped tube 800 has first, second, and third inner tube portions 871, 872, 873 coupled together each having a first diameter. The first, second, and third inner tube portions 871, 872, 873 define an outer surface 876. The first and second inner tube portions 871, 872 extend parallel to one another, and the third inner tube portion 873 extends perpendicular to and between the first and second inner tube portions 871, 872. The first inner tube portion 871 includes an open end 881 (shown in FIG. 19), and the second inner tube portion 872 includes an open end 882. In an exemplary embodiment, the inner u-shaped tube 800 is constructed of a metal such as steel example.

Referring to FIGS. 21-24, the housing 802 has an inner surface 900 and an open end 902. The inner u-shaped tube 800 is at least partially disposed in the housing 802. In an exemplary embodiment, the housing 802 is constructed of a metal such as steel example. An interior region 803 is formed between the outer surface 876 of the inner u-shaped tube 800 and the inner 900 surface of the housing 802.

Figure 19:
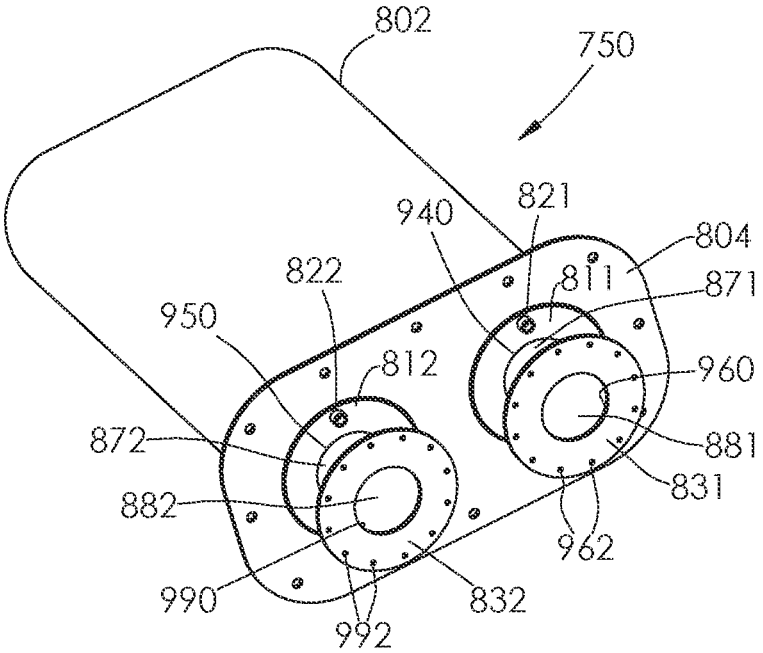
FIG. 19 is an isometric view of a coolant-filled heat exchanger in accordance with another exemplary embodiment.
Figure 20:
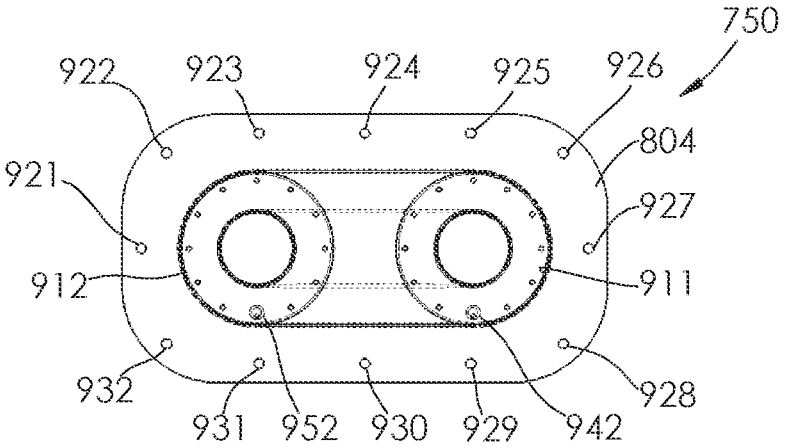
FIG. 20 is an end view of the coolant-filled heat exchanger of FIG. 19.
Figure 21:
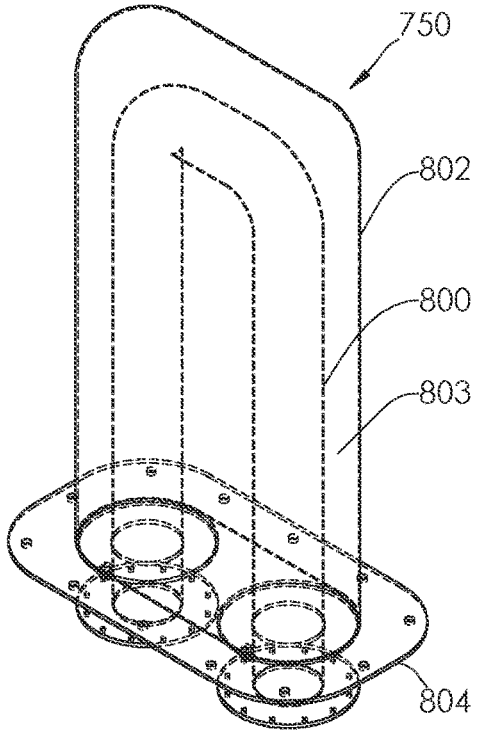
FIG. 21 is a partially transparent isometric view of the coolant-filled heat exchanger of FIG. 19.
Figure 22:
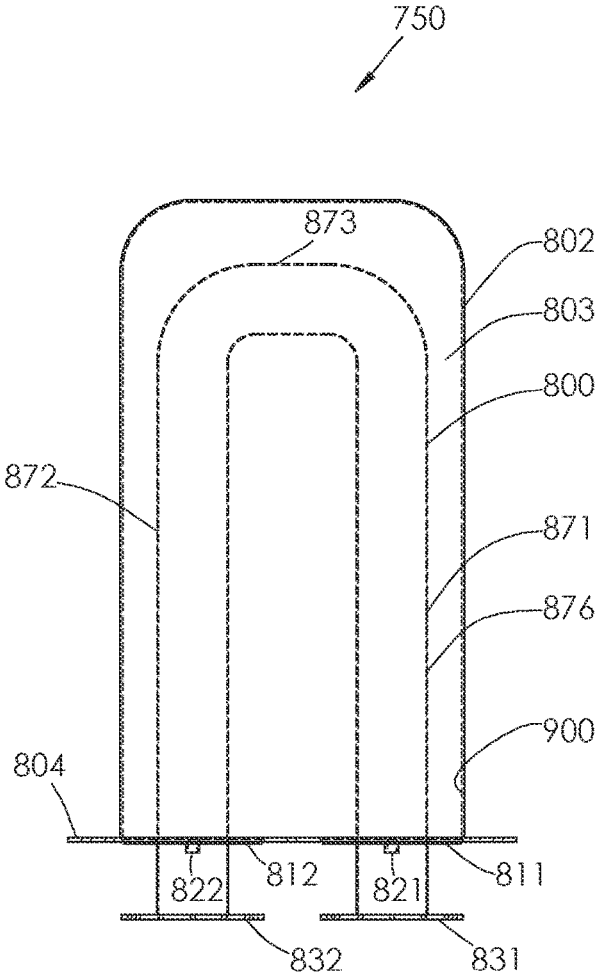
FIG. 22 is a partially transparent front view of the coolant-filled heat exchanger of FIG. 19.
Figure 23:
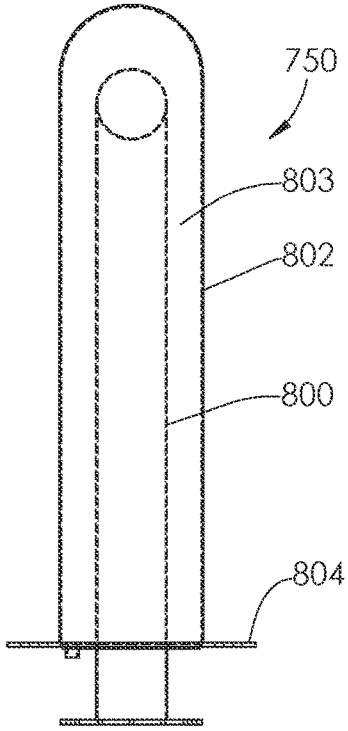
FIG. 23 is a partially transparent side view of the coolant-filled heat exchanger of FIG. 19.
Figure 24:
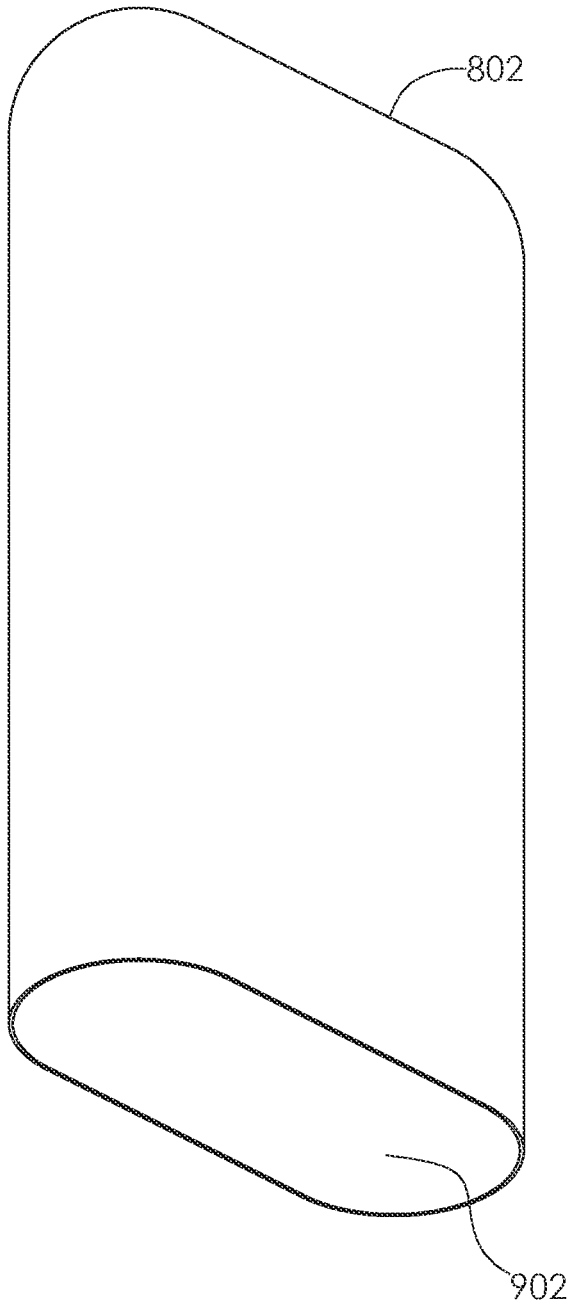
FIG. 24 is an isometric view of a housing utilized in the coolant-filled heat exchanger of FIG. 19.

Referring to FIGS. 19 and 20, the mounting plate 804 is coupled to the housing 802 and encloses the open end 902. The mounting plate 804 has first and second apertures 911, 912, and bolt holes 921, 922, 923, 924, 925, 926, 97, 928, 929, 930, 931, 932 extending therethrough.

Referring to FIGS. 3, 19 and 20, in this alternative embodiment, the bolts 61, 62, 63, 64, 65, 66, 67, 68, 69, 70, 71, 72 extend through the bolt holes 921, 922, 923, 924, 925, 926, 97, 928, 929, 930, 931, 932, respectively of the mounting plate 804, and into the bolt holes 141, 142, 143, 144, 145, 146, 147, 148 149, 100, 152, respectively, of the ring-shaped mounting flange 32 to couple the mounting plate 804 to the ring-shaped mounting flange 32. In an exemplary embodiment, the mounting plate 804 is constructed of a metal such as steel for example.

Referring to FIGS. 19 and 20, the first ring-shaped end plate 811 is disposed in the first aperture 911 of the mounting plate 804 and is coupled to the mounting plate 804. The first ring-shaped end plate 811 has a central aperture 940 that the first inner tube portion 871 of the inner u-shaped tube 800 extends therethrough. The first inner tube portion 871 is coupled to the first ring-shaped end plate 811.

The first ring-shaped end plate 811 is disposed a first distance from the open end of the first inner tube portion 871. The first ring-shaped end plate 811 has a port aperture 942 that receives a first fluid port 821 therein. The first fluid port 821 is coupled to the first ring-shaped end plate 811 and fluidly communicates with the interior region 803. In an exemplary embodiment, the first ring-shaped end plate 811 is constructed of a metal such as steel for example.

The second ring-shaped end plate 812 is disposed in the second aperture 912 of the mounting plate 804 and is coupled to the mounting plate 804. The second ring-shaped end plate 812 has a central aperture 950 that the second inner tube portion 872 of the inner u-shaped tube 800 extends therethrough. The second inner tube portion 872 is coupled to the second ring-shaped end plate 812.

The second ring-shaped end plate 812 is disposed a first distance from the open end of the second inner tube portion 872. The second ring-shaped end plate 812 has a port aperture 952 that receives a second fluid port 822 therein. The second fluid port 822 is coupled to the second ring-shaped end plate 812 and fluidly communicates with the interior region 803. In an exemplary embodiment, the second ring-shaped end plate 812 is constructed of a metal such as steel for example.

The interior region 303 is filled with a coolant utilizing the first and second fluid ports 821, 822. In particular, after the installation of the coolant-filled heat exchanger 750 with the storage tank 30, a coolant is pumped from an exterior coolant tank (not shown) through the fluid port 822 into the interior region 803 of the storage tank 30 while air is evacuated out of the fluid port 821. The fluid port 821 is sealed after the coolant is disposed in the interior region 803. The fluid port 822 is coupled to the tube 241 (shown in FIG. 1) which is further coupled to the pressure relief valve 250. The pressure relief valve 250 is further coupled to the expansion tank 252. In an exemplary embodiment, the coolant is a liquid coolant. Further, in an exemplary embodiment, the liquid coolant is at least one of an ethylene glycol/water mixture and a mono-ethylene glycol. The liquid coolant maintains a temperature in the interior region 803 at approximately 212 degrees Fahrenheit.

The first ring-shaped coupling flange 831 is coupled to an end of the first inner tube portion 871 that extends outwardly from the mounting plate 804. The first ring-shaped coupling flange 831 includes a central aperture 960 and a plurality of bolt holes 962 extending therethrough. The central aperture 960 aligns with and fluidly communicates with the open end 881 of the first inner tube portion 871. A plurality of bolts (not shown) are disposed through the plurality of bolt holes 962 and a plurality of bolt holes 596 (shown in FIG. 3) of the mounting member 552 of the burner assembly 80 to couple the first ring-shaped coupling flange 831 to the mounting member 552. In an exemplary embodiment, the first ring-shaped coupling flange 831 is constructed of a metal such as steel for example.

The second ring-shaped coupling flange 832 is coupled to an end of the second inner tube portion 872 that extends outwardly from the mounting plate 804. The second ring-shaped coupling flange 832 includes a central aperture 990 and a plurality of bolt holes 992 extending therethrough. The central aperture 990 aligns with and fluidly communicates with the open end 882 of the second inner tube portion 872. A plurality of bolts (not shown) are disposed through the plurality of bolt holes 992 and the plurality of bolt holes 664 (shown in FIG. 3) of the ring-shaped mounting flame 662 of the exhaust assembly 90 to couple the second ring-shaped coupling flange 832 to the exhaust assembly 90. In an exemplary embodiment, the second ring-shaped coupling flange 832 is constructed of a metal such as steel for example.

The coolant-filled heat exchangers described herein provide a substantial advantage over other structures. In particular, the heat exchangers maintain a temperature at approximately 212 degrees Fahrenheit along an outer u-shaped tube or a housing to reduce hot spots on the outer u-shaped tube or housing which increases an operational life of the coolant-filled heat exchangers.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A coolant-filled heat exchanger for an oil treater, comprising:

an inner u-shaped tube having first, second, and third inner tube portions each having a first diameter, the first, second, and third inner tube portions defining an outer surface;

an outer u-shaped tube having first, second, and third outer tube portions each having a second diameter; the second diameter being greater than the first diameter, the first, second, and third outer tube portions defining an inner surface, the first, second, and third inner tube portions being disposed within the first, second, and third outer tube portions, respectively, an interior region being formed between the outer surface of the inner u-shaped tube and the inner surface of the outer u-shaped tube;

a mounting plate having first and second apertures extending therethrough, the first outer tube portion extending into the first aperture and being coupled to the mounting plate, the second outer tube portion extending into the second aperture and being coupled to the mounting plate;

a first ring-shaped end plate coupled to and between the outer surface of the first inner tube portion and the inner surface of the first outer tube portion to enclose and seal a first opening communicating with the interior region, the first ring-shaped end plate being disposed a first distance from an open end of the first inner tube portion; and a second ring-shaped end plate coupled to and between the outer surface of the second inner tube portion and the inner surface of the second outer tube portion to enclose and seal a second opening communicating with the interior region, the second ring-shaped end plate being disposed the first distance from an open end of the second inner tube portion, the interior region being adapted to be filled with a coolant;

wherein the mounting plate is configured to be removably fixed to a storage tank of the oil treater such that the inner u-shaped tube and the outer u-shaped tube are at least partially located within the storage tank.

2. The coolant-filled heat exchanger of claim 1, wherein:

the first inner tube portion extends outwardly from the mounting plate; and the second inner tube portion extends outwardly from the mounting plate.

3. The coolant-filled heat exchanger of claim 2, further comprising:

a first ring-shaped flange being coupled to the exterior surface of the first inner tube portion proximate to the open end of the first inner tube portion; and a second ring-shaped flange being coupled to the exterior surface of the second inner tube portion proximate to the open end of the second inner tube portion.

4. The coolant-filled heat exchanger of claim 2, wherein:

the first and second inner tube portions extending parallel to one another, and the third inner tube portion extending perpendicular to and between the first and second inner tube portions.

5. The coolant-filled heat exchanger of claim 4, wherein:

the first and second outer tube portions extending parallel to one another, and the third outer tube portion extending perpendicular to and between the first and second outer tube portions.

6. The coolant-filled heat exchanger of claim 1, further comprising:

a centralizer member being disposed in the first inner tube portion, the centralizer member adapted to hold a burner nozzle at a central position within the first inner tube portion.

7. The coolant-filled heat exchanger of claim 1, wherein:

the first ring-shaped end plate having a first fluid port coupled thereto that fluidly communicates with the interior region; and the second ring-shaped end plate having a second fluid port coupled thereto that fluidly communicates with the interior region.

8. The coolant-filled heat exchanger of claim 7, further comprising:

a first tube coupled to and between the first fluid port and a pressure relief valve; and a second tube coupled to and between the pressure relief valve and an expansion tank, wherein when a pressure of the coolant in the interior region is greater than a threshold pressure, the pressure relief valve routes a portion of the coolant from the interior region to atmosphere.

9. The coolant-filled heat exchanger of claim 1, wherein the first diameter is eight inches, and the second diameter is sixteen inches.

10. The coolant-filled heat exchanger of claim 1, wherein the coolant is a liquid coolant.

11. The coolant-filled heat exchanger of claim 10, wherein the liquid coolant is at least one of an ethylene glycol/water mixture and a mono-ethylene glycol.

12. The coolant-filled heat exchanger of claim 10, wherein the liquid coolant that maintains a temperature in the interior region at approximately 212 degrees Fahrenheit.

* * * * *